US009863014B2

(12) United States Patent
Ha et al.

(10) Patent No.: US 9,863,014 B2
(45) Date of Patent: Jan. 9, 2018

(54) LANCE AND OPERATION METHOD USING THE SAME

(71) Applicant: POSCO, Pohang-Si (KR)

(72) Inventors: Chang Su Ha, Seoul (KR); Hyeon Soo Choi, Pohang-Si (KR)

(73) Assignee: POSCO, Pohang-si (KR)

( * ) Notice: Subject to any disclaimer, the term of this patent is extended or adjusted under 35 U.S.C. 154(b) by 181 days.

(21) Appl. No.: 14/653,376

(22) PCT Filed: Dec. 16, 2013

(86) PCT No.: PCT/KR2013/011637
§ 371 (c)(1),
(2) Date: Jun. 18, 2015

(87) PCT Pub. No.: WO2014/098427
PCT Pub. Date: Jun. 26, 2014

(65) Prior Publication Data

US 2015/0344982 A1 Dec. 3, 2015

(30) Foreign Application Priority Data

Dec. 18, 2012 (KR) ..... 10-2012-0148862

(51) Int. Cl.
*F23D 14/62* (2006.01)
*F27D 3/16* (2006.01)
(Continued)

(52) U.S. Cl.
CPC ..... *C21C 5/4606* (2013.01); *C21C 7/072* (2013.01); *F27D 3/16* (2013.01); *C21C 5/305* (2013.01);
(Continued)

(58) Field of Classification Search
CPC ..... C21C 5/4606; C21C 2100/02; F27D 3/16; F27D 2003/163; F27D 2003/169; F23D 14/62
See application file for complete search history.

(56) References Cited

FOREIGN PATENT DOCUMENTS

| | | |
|---|---|---|
| CN | 2315438 | 4/1999 |
| JP | 52022136 | 2/1977 |

(Continued)

OTHER PUBLICATIONS

Machine transkation of KR 2000-0039994 A, published Jul. 2000.*

(Continued)

*Primary Examiner* — George Wyszomierski
*Assistant Examiner* — Tina M McGuthry Banks
(74) *Attorney, Agent, or Firm* — Cantor Colburn LLP

(57) ABSTRACT

Provided is a lance and an operation method using the same, in which a suction hole allowing source gas to be injected into a container, in which a reaction gas is generated, is included. The suction hole is formed in a source gas passage where the reaction gas is introduced into the passage. Thus the temperature of the gas injected into the container may be easily increased without using any separate heating device, and secondary combustion efficiency may be increased. In addition, the gas sprayed at a high temperature is provided, and thus additional heat may be supplied into the container. Thus, excessive use of fuel used to increase the temperature of the container may be avoided, and thus operation costs may be reduced and operation efficiency and productivity may be increased.

5 Claims, 7 Drawing Sheets

(51) Int. Cl.

| | |
|---|---|
| ***C21C 5/48*** | (2006.01) |
| ***C21C 5/46*** | (2006.01) |
| ***C21C 7/072*** | (2006.01) |
| *C21C 5/30* | (2006.01) |
| *C21C 5/32* | (2006.01) |

(52) U.S. Cl.
CPC ..... *C21C 5/32* (2013.01); *C21C 2100/02* (2013.01); *F27D 2003/163* (2013.01); *F27D 2003/169* (2013.01)

(56) References Cited

FOREIGN PATENT DOCUMENTS

| | | | | |
|---|---|---|---|---|
| JP | 53128027 | | 11/1978 | |
| JP | 59197512 | | 11/1984 | |
| JP | 59197512 | A * | 11/1984 | ..... C21C 5/4606 |
| JP | 62164813 | | 7/1987 | |
| JP | 62164813 | A * | 7/1987 | |
| JP | 07126732 | | 5/1995 | |
| JP | 2000345228 | | 12/2000 | |
| JP | 2001220617 | | 8/2001 | |
| JP | 2003231911 | | 8/2003 | |
| JP | 2007077489 | | 3/2007 | |
| JP | 2011202236 | | 10/2011 | |
| KR | 1020000039994 | | 7/2000 | |
| LU | 47618 | | 2/1965 | |
| WO | WO 9702365 | A1 * | 1/1997 | ..... C21C 5/4606 |

OTHER PUBLICATIONS

Hae Won Kim, Machine Translation of KR 10-2000-0039994, published Apr. 2000.*

Full Human translation of KR 2000003994 (Kim Hae Won), published Jul. 2000.*

Full Human translation of JP 62164813 A (Chikama), published Jul. 1987.*

Full Human translation of JP 59197512 A (Okuda et al.), published Nov. 1984.*

International Search Report—PCT/KR2013/011637 dated Mar. 18, 2014.

Written Opinion—PCT/KR2013/011637 issued on Mar. 18, 2014, citing KR 10-2000-0039994, JP 2001-220617, JP 2007-077489 and JP 07-126732.

European Search Report—European Application No. 13864067.7, issued on Jun. 23, 2016, citing JP S62 164813, LU 47 618 and KR 2000 0039994.

* cited by examiner

LANCE AND OPERATION METHOD USING THE SAME

TECHNICAL FIELD

The present disclosure relates to a lance and an operation method using the same, and more particularly, to a lance and an operation method using the same capable of increasing a secondary combustion efficiency in a container generating CO gas.

BACKGROUND ART

In general, molten iron is prepared in a converter such that oxygen is supplied into the molten iron to oxidize carbon (C), silicon (Si), manganese (Mn), etc., contained in the molten iron. The temperature of the molten iron increases by itself due to heat generated while the above-mentioned components are being oxidized. Here, in general, a scrap ratio at which operation is possible by using the self-generated heat of the molten iron is approximately 20%.

Accordingly, to increase an operation ratio of the scraps, a method in which a material capable of generating heat by reacting with oxygen (for example, silicon (Si) or carbon (C)) is added into the molten iron, has been used.

Alternatively, a method of using secondary combustion heat, which is generated when CO gas generated during decarburization refinement performed in the converter is reacted with oxygen once more to be changed into $CO_2$, is also used. More specifically, a lance is positioned over molten iron contained in a converter, and an oxidative gas is then supplied into the molten iron to thereby generate heat through decarburization treatment of the molten iron.

In the decarburization treatment, a reaction in which carbon (C) in the molten iron and oxygen ($O_2$) in the oxidative gas are reacted to generate CO is performed as described in the following Formula 1. Then, a reaction of the following Formula 2 (hereinafter, referred to as a secondary combustion) is performed, in which the CO generated by the above primary combustion and the oxygen in the oxidative gas are reacted again to generate $CO_2$.

$$C+\tfrac{1}{2}O_2 \rightarrow CO \quad \text{[Formula 1]}$$

$$CO+\tfrac{1}{2}O_2 \rightarrow CO_2 \quad \text{[Formula 2]}$$

As such, the secondary combustion occurs such that oxygen blown from a lance and CO gas generated in a converter are mixed and reacted, and the blown oxygen generally has a speed lower than the speed of sound. Accordingly, to accelerate the secondary combustion, a method for blowing oxygen at a speed equal to or less than the speed of sound is required. Also, it is advantageous that a moving distance of an oxygen jet to the molten iron is made long so as to allow the reaction of oxygen to be maintained for a long time.

Accordingly, in related arts, the methods for reducing the flow speed of the oxygen jet to increase the secondary combustion, such as, 1) a method in which the height of a lance over the molten iron is raised, 2) a method in which the oxygen jet is distributed by using a porous lance nozzle, 3) a method in which the shape of the lance nozzle is changed. Here, the method 3) is the easiest method for increasing the secondary combustion, and thus methods for accelerating the second combustion by changing the nozzle in various shapes to make the speed of the oxygen jet to be the speed of sound or less are used.

For example, the secondary combustion was accelerated by using a lance which has an expanded portion with a non-circular section so that the flow speed of the gas becomes the speed of sound or more before a throat provided in the lance, and becomes the speed of sound or less in a lower portion of the throat.

Alternatively, a plurality of separate gas supply holes are disposed at sidewalls of gas discharge holes of a general porous oxygen nozzle formed in the lance. Here, a method of reducing a flow speed of a gas jet by supplying gas to the gas supply holes to provide a swirl flow to the oxygen jet is used.

Alternatively, a lance, which changes a spraying direction of the sprayed gas without a decrease in a flow speed of oxidative gas sprayed from the lance and a changing in an inclined angle of a nozzle, is proposed. That is, proposed is a method, in which at least one nozzle in a lance provided with at least two gas spraying nozzles periodically sprays the gas along a direction crossing a straight line connecting a center point of the gas spray nozzle and a center point of a lateral cross-section of the lance. It is asserted that this method can improve the secondary combustion, and allow base metal attached to the wall of a converter to be uniformly melted.

Alternatively, a hole through which a control gas may be supplied is formed at a side surface of an expanded portion of a supersonic nozzle, and the control gas is blown therethrough. Accordingly, methods for changing the direction of the blown oxidative gas and reducing the speed are also used.

Also, a lance, in which expansion nozzles are disposed at a front end of the lance to face each other at positions of point symmetry with respect to the lance center, and a straight nozzle is disposed at other positions of a same concentric circle, is proposed to uniformly melt the base metal attached to the inner wall of a converter.

However, related art methods are used to generate a secondary combustion such that oxygen at room temperature is supplied into a converter and is reacted with high-temperature CO generated during decarburization. Accordingly, a temperature higher than a predetermined level is required for the combustion of CO. The second combustion does not occur until the oxygen at room temperature is mixed with CO and the temperature is raised. Thus, in general, in order that the blown oxygen may be slowly reacted with CO gas from a surface thereof, a secondary combustion may then occur, and the entire oxygen jet to the inside thereof may be used for the secondary combustion, the oxygen jet should move a substantial distance.

DISCLOSURE OF THE INVENTION

Technical Problem

The present disclosure provides a lance and an operation method using the same, in which secondary combustion efficiency may be increased.

The present disclosure also provides a lance and an operation method using the same, in which the temperature of oxidative gas may be easily raised.

The present disclosure also provides a lance and an operation method using the same, in which the flow rate of a gas blown into a melt may be increased.

The present disclosure also provides a lance and an operation method using the same, in which the productivity and efficiency of a process may be increased.

Technical Solution

In accordance with an exemplary embodiment, a lance for blowing a source gas into a container in which a reaction gas is generated includes a suction hole which is formed at a gas passage and configured to introduce the reaction gas into the passage.

The lance may include a wall body formed to extend vertically, and configured to separate the outside and the passage; a storage part disposed over the suction hole, and configured to accommodate the source gas; a mixing part disposed under the suction hole, and configured to mix the source gas and the reaction gas therein; and a discharge part formed under the mixing part to extend a predetermined distance, and configured to discharge the gas into container.

The storage part may be gradually narrowed toward the suction hole.

A discharge hole configured to discharge the source gas to the mixing part may be formed at an end of the storage part, and the suction hole may penetrate through the wall body to allow the passage to communicate with the outside.

The discharge hole may include an introduction end through which the source gas is introduced and a discharge end facing the introduction end, the discharge hole being gradually broadened from the introduction end toward the discharge end.

The mixing part may be gradually narrowed toward the discharge part.

An end of the discharge part may be gradually broadened in a downward direction.

The suction hole may be formed to be inclined toward the inside of the wall part.

In accordance with another exemplary embodiment, an operation method for refining molten iron includes: preparing molten iron in a container; lowering a lance into the container to position the lance over the molten iron; supplying an oxidative gas to the lance and to spray the oxidative gas to molten iron; and introducing, into the lance, a reaction gas generated by the oxidative gas that is sprayed to the molten iron.

The operation method may further include introducing the reaction gas into the lance, and mixing the introduced reaction gas and the oxidative gas.

The operation method may further include mixing the reaction gas and the oxidative gas and spraying the mixed gas into the container.

The reaction gas may be CO gas.

Advantageous Effects

In accordance with a lance and an operation method using the same, the temperature of the oxidative gas blown into molten iron may be easily raised without a separate heating apparatus, and thus efficiency of a secondary combustion may be increased. That is, a portion of high-temperature CO gas generated in a converter during a blow refinement of molten iron is suctioned into a lance and discharged after reacting with oxygen, and thus the gas may be discharged at a high temperature.

Also, the CO gas is suctioned into the lance and is blown into the container in a state mixed with an oxidative gas, and thus a flow rate of the gas blown into the reaction container may be increased. Accordingly, a blown amount of the oxidative gas consumed in a process may be decreased.

In addition, a gas sprayed at a high temperature is supplied, and thus additional heat may be efficiently supplied into the container. Thus, excessive use of scraps, low-price iron sources, and heating agents which have been typically used to increase the temperature of the container in related arts may be avoided, and thus costs consumed in a process may be reduced and the efficiency and productivity of a process may be increased.

BRIEF DESCRIPTION OF THE DRAWINGS

Exemplary embodiments can be understood in more detail from the following description taken in conjunction with the accompanying drawings, in which.

EXPLANATION OF REFERENCE CHARACTERS

Figure 1:
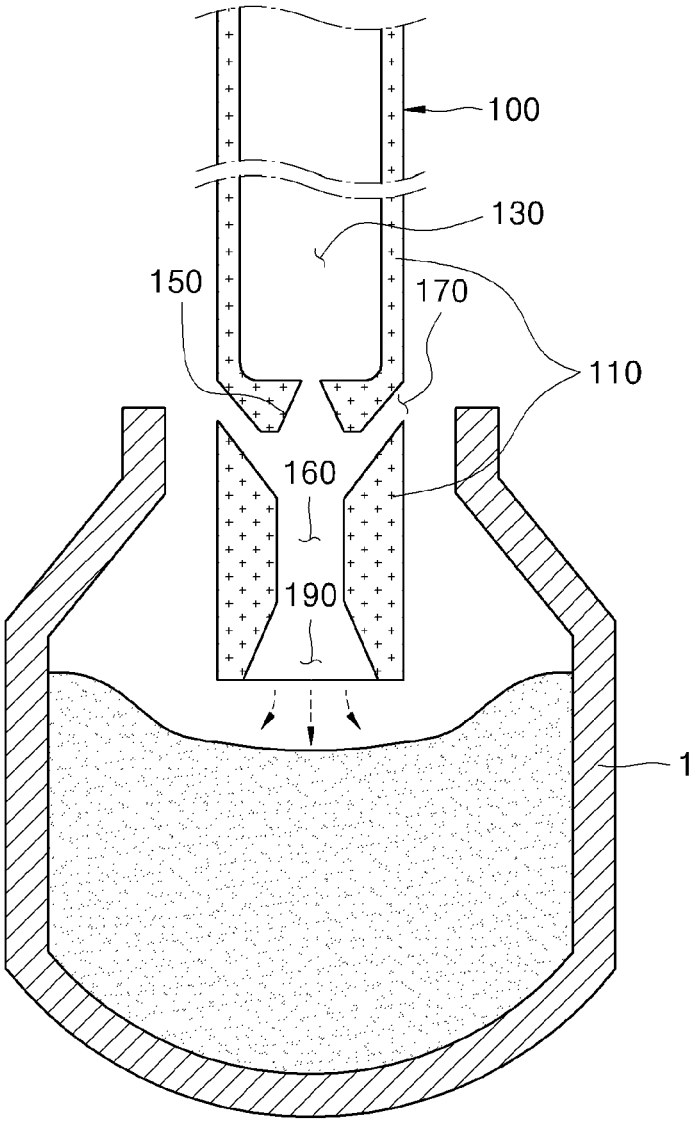
FIG. 1 is a view schematically illustrating a converter operation process in accordance with an exemplary embodiment.

1: Converter
100: Lance
110: Wall body
130: Storage part
150: Discharge part
160: Mixing part
170: Suction hole
190: Discharge part

MODE FOR CARRYING OUT THE INVENTION

Hereinafter, embodiments will be described in more detail with reference to the accompanying drawings. The present disclosure may, however, be in different forms and should not be construed as limited to the embodiments set forth herein. Rather, these embodiments are provided so that this disclosure will be thorough and complete and will fully convey the scope of the present disclosure to those skilled in the art. In the drawings, like reference numerals refer to like elements throughout.

A lance and an operation method using the same in accordance with exemplary embodiments are a lance and an operation in which a source gas is blown into a container generating a reaction gas. In the exemplary embodiments, the reaction gas may be CO gas, the container may be a converter, and the source gas may be an oxidative gas.

Figure 2:
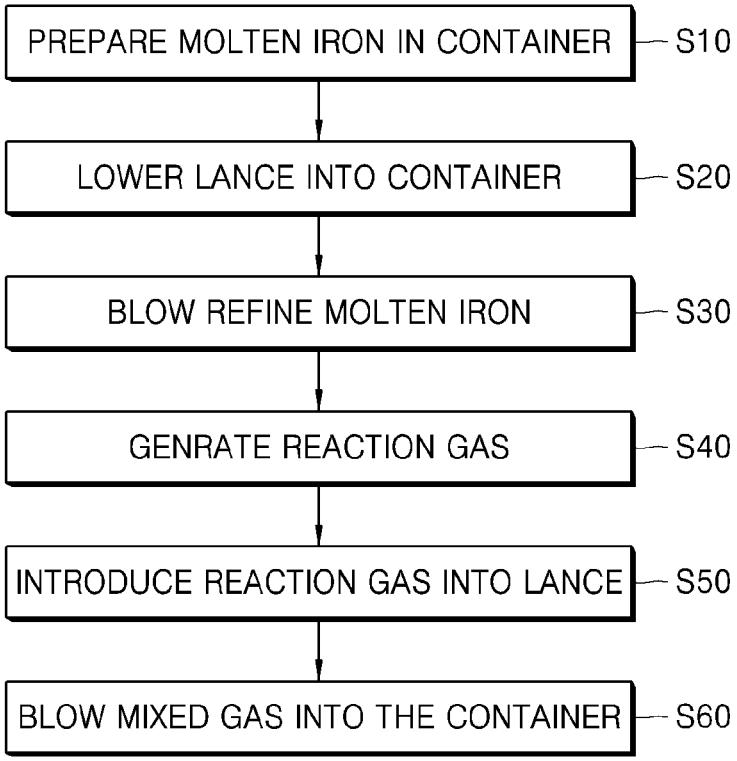
FIG. 2 is a flowchart illustrating an operation method in accordance with an exemplary embodiment.
Figure 3:
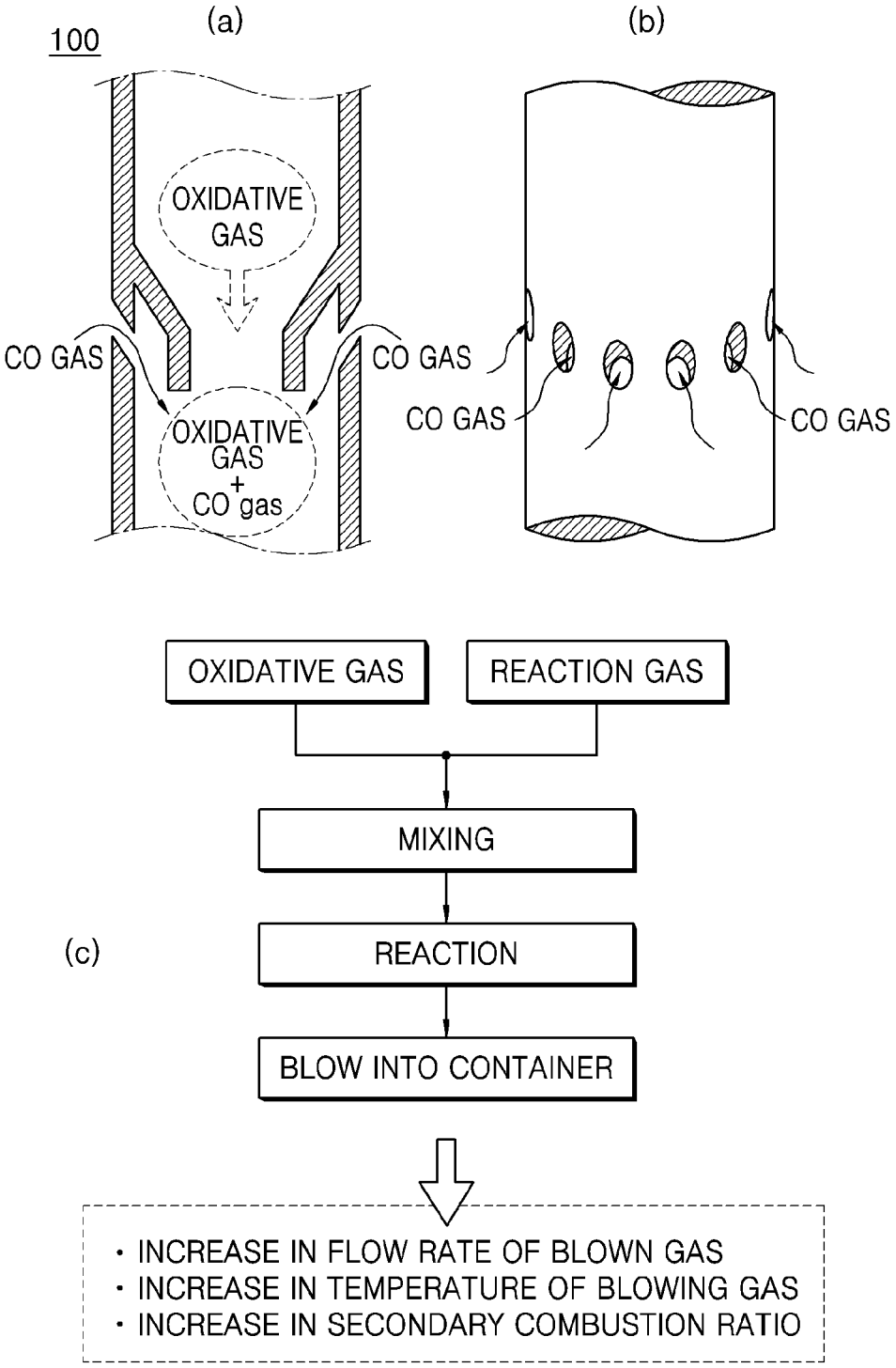
FIG. 3 is a view illustrating an effect of a converter operation due to a lance in accordance with an exemplary embodiment.
Figure 4:
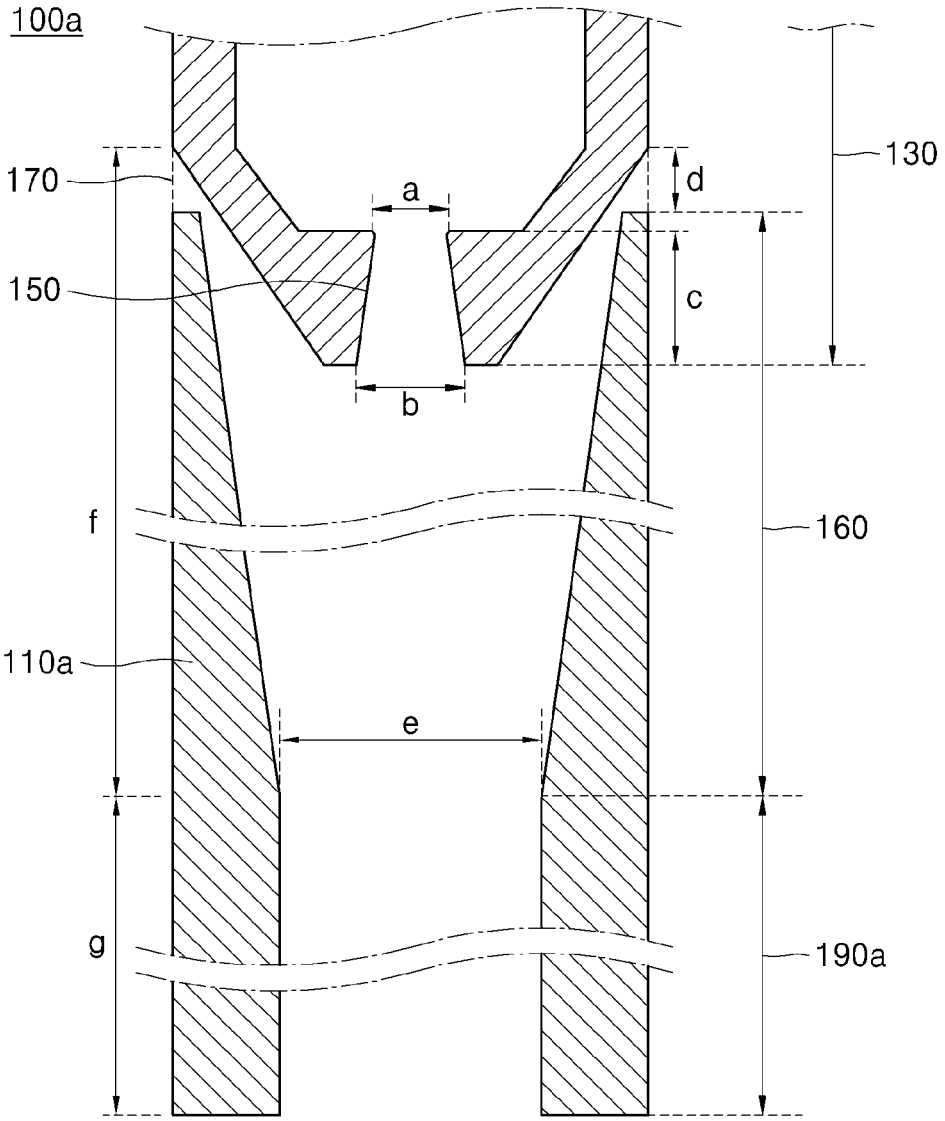
FIG. 4 is a view illustrating a lance of Embodiment 1 in accordance with an exemplary embodiment.
Figure 5:
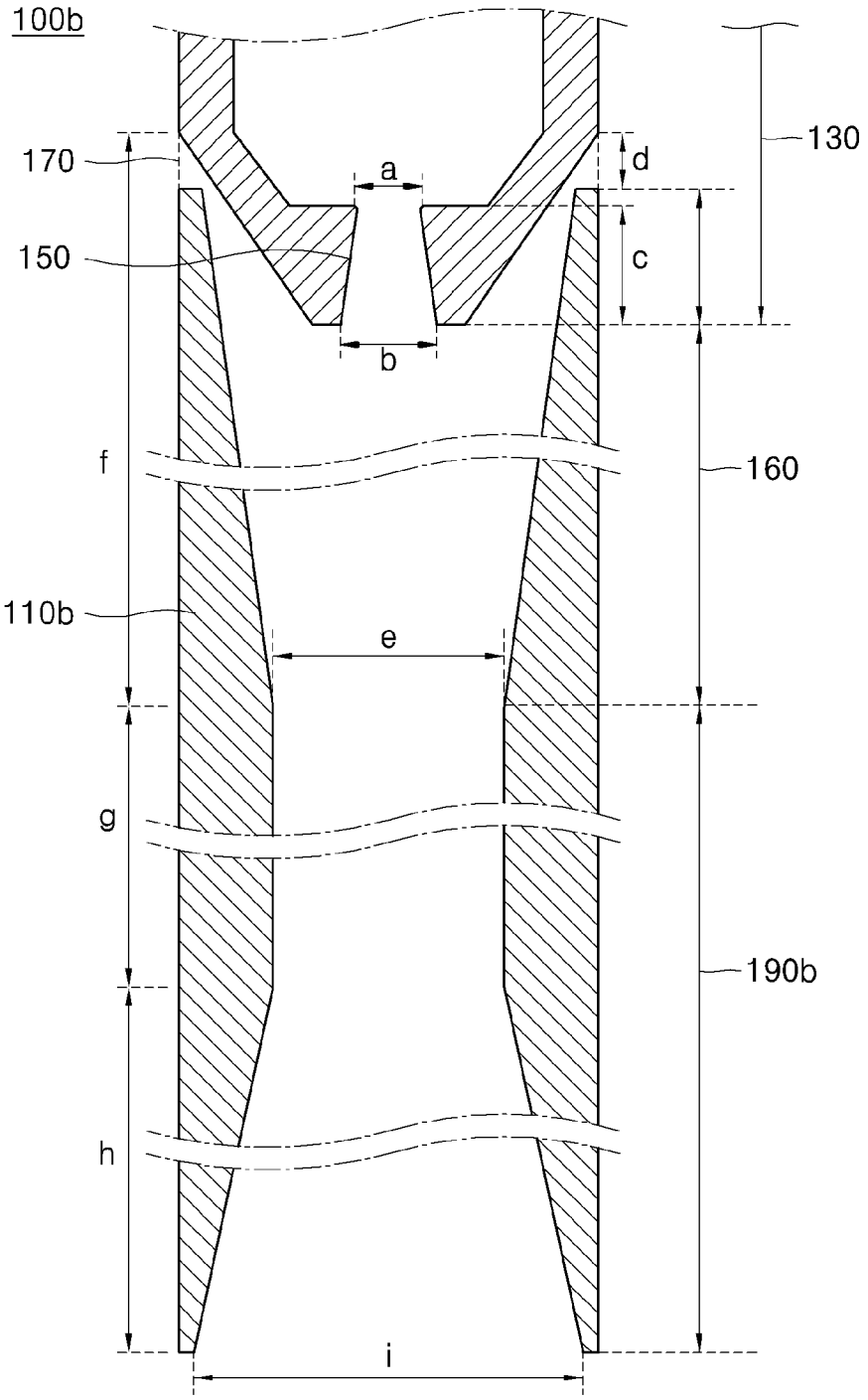
FIG. 5 is a view illustrating a lance of Embodiment 2 in accordance with an exemplary embodiment.

FIG. 1 is a view schematically illustrating a converter operation process in accordance with an exemplary embodiment. FIG. 2 is a flowchart illustrating an operation method in accordance with an exemplary embodiment. FIG. 3 is a view illustrating an effect of a converter operation due to a lance in accordance with an exemplary embodiment. FIG. 4 is a view illustrating a lance of Embodiment 1 in accordance with an exemplary embodiment. FIG. 5 is a view illustrating a lance of Embodiment 2 in accordance with an exemplary embodiment.

A lance 100 in accordance with an exemplary embodiment is a lance for blowing an oxidative gas into a converter 1 where CO gas is generated, and includes a suction hole 170 which is formed at an oxidative gas passage and configured to introduce the CO gas into the passage.

The converter 1 is equipment for preparing molten iron and formed in a shape of a hollow container with an open upper side for accommodating the molten iron transferred from a blast furnace. The converter 1 is equipment in which, after accommodating the molten iron, a blow refinement is performed such that an oxidative gas such as oxygen is blown into the molten iron to oxidize and remove foreign substances contained in the molten iron.

The lance 100 is formed to extend vertically, has a tubular shape defining an internal passage through which the oxidative gas supplied from a gas supply part passes, and is generally formed to have a cylindrical shape. The lance 100 may include a wall body 110 configured to separate the outside and the passage; a storage part 130 disposed over a suction hole 170, and configured to accommodate the source gas; a mixing part 160 disposed under the suction hole 170, and configured to mix the source gas and the reaction gas therein; and a discharge part 190 formed under the mixing part 160 to extend a predetermined distance, and configured to discharge the gas into the converter 1.

The wall body 110 is provided to shield a gas passage from the outside, and the gas passage and the storage part 130 accommodating the gas are formed therein. Accordingly, the storage part 130 and the passage may be shielded from the outside. Also, the wall body 110 may be designed such that cooling water flows therein to protect the lance 100 and a nozzle from high-temperature operation environment.

The storage part 130 is formed to extend a predetermined length over the suction hole 170, and the discharge part 150 for discharging an oxidative gas to the mixing part 160 is formed at an end thereof. The storage part 130 defines a space, in which the oxidative gas supplied from a gas supply apparatus is stored, to thereby accommodate the oxidative gas. The storage part 130 is formed to be gradually narrowed toward the suction hole 170, and thus the oxidative gas accommodated in the storage part 130 may be concentrated and moved to the mixing part 160. Here, although, in FIGS. 4 and 5, the storage part 130 becomes narrower by being inclined, methods of reducing the width of the storage part 130 is not limited thereto, and thus the storage part 130 may be narrowed in various ways. That is, when the width of the storage part 130 becomes smaller, a space of the storage part 130 may be increased if the storage part 130 is smoothly narrowed in a curved shape.

In the lance 100 in accordance with an exemplary embodiment, although the storage part 130 is formed in the same cylindrical shape as the lance 100, the shape of the storage part is not limited thereto, but may be modified in various shapes. Also, the size of the storage part 130 (that is, a space which may accommodate the oxidative gas) is not limited thereto, but the storage part 130 may be formed in a size such that a speed of the oxidative gas may be changed by a pressure difference when the oxidative gas accommodated in the storage part 130 passes the discharge hole 150.

The discharge hole 150 is formed at an end of the storage part 130 to discharge the oxidative gas to the mixing part 160, and includes an introduction end into which the oxidative gas is introduced and a discharge end facing the introduction end. Here, the discharge hole 150 may be formed to be gradually broadened from the introduction end toward the discharge end of the discharge hole 150. Accordingly, the speed of the oxidative gas is increased to reach the speed of sound when the oxidative gas passes through the discharge hole 150, and the oxidative gas is then discharged at a speed equal to or higher than the speed of sound when the oxidative gas is discharged to a lower portion of the lance 100. Although the discharge hole 150 is disposed at only a point of the lance 100, the number of discharge holes 150 may be changed depending on the length and shape of the lance 100.

The mixing part 160 is disposed under the suction hole 170 to mix the oxidative gas and the CO gas. Here, the mixing part 160 may be formed to extend by a predetermined length in order to accommodate the oxidative gas supplied from the storage part 130 and to provide a time for which the CO gas introduced through the suction hole 170 may be mixed. That is, as illustrated in FIGS. 4 and 5, the mixing part 160 may be formed in a length such that the oxidative gas and the CO gas may sufficiently react in the mixing part 160. Also, the mixing part 160 may be gradually narrowed toward discharge part 190 formed thereunder. This is because the gas mixed in the mixing part 160 may be rapidly moved to the discharge part 190 by virtue of the gradually narrowed shape of the mixing part 160. More detailed description will be given later. Also, the method in which the mixing part 160 is formed to be gradually narrowed may be realized by allowing the width to become smaller through a linear or curved shape, as described in regard to the storage part 130.

The suction hole 170 is the most important component, and is disposed at an oxidative gas passage in the lance 100 to suction external gas of the lance 100. That is, referring to the drawing, the suction hole 170 communicates with the outside by penetrating the wall body 110 of the lance 100. The suction hole 170 may be formed to be inclined toward the inside of the wall body 110 so that the oxidative gas flowing in the lance 100 may be prevented from being discharged through the suction hole 170 and external gas may move to the mixing part 160 to be mixed with the oxidative gas. That is, the suction hole 170 is inclined toward a lower portion of the lance 100, from an external circumferential surface to the inside of the wall body 100.

The CO gas, which is generated through reaction of oxygen in the oxidative gas blown into the molten iron of the converter 1 and carbon in the molten iron, is suctioned through the suction hole 170 thus formed. The CO gas is introduced to the mixing part 150 through a passage formed at a portion at which the storage part 130 and the mixing part 160 overlap. That is, the oxidative gas and the carbon reacts, so that the CO gas exists in the converter 1, and the CO gas may be blown into the lance 100 by using a Venturi effect by which surrounding gas is swirled into when the oxidative gas is blown at a high speed.

The suction hole 170 may have a different optimal size depending on the shape of the lance 100. However, since a flow rate of the CO gas suctioned from the outside may be decreased due to a small pressure difference when the suction hole 170 is too large, it is desirable that the suction hole 170 may have a suitable size. Accordingly, the present disclosure is not limited to the size and shape of the suction hole 170, but describes only an effect of the suction hole 170 through a change in effects in accordance with the size of the suction hole 170 of the lance of Embodiment 2 described later.

The discharge part 190 is formed to extend by a predetermined distance under the mixing part 160, and allow the gas moved from the mixing part 160 to be discharged into the converter 10. Here, the shape of the discharge part 190 is not limited thereto, but may be formed in a direction parallel to the gas moving direction in order that gas moving at a high speed in the lance 100 is rapidly blown into the molten iron through the discharge part 190. Although the discharge part 190 may be formed to have no change in width as illustrated in the discharge part 190*a* illustrated in FIG. 4, the discharge part 190 may also be formed to have an end that is gradually broadened in a downward direction. Effect of each of the discharge parts 190*a* and 190*b* will be described below in detail.

The operation method using the lance 100 formed as described above in accordance with an exemplary embodiment and resulting effects will be described as follows.

The operation method in accordance with an exemplary embodiment is an operation method for refining molten iron, and includes: preparing molten iron in the converter 1; lowering a lance into the converter 1 to position the lance 100 over the molten iron; supplying an oxidative gas to the lance 100 and spraying the oxidative gas to molten iron; and introducing, into the lance 100, a reaction gas generated by the oxidative gas that is sprayed into the molten iron.

Hereinafter, the operation method will be described in detail.

First, molten iron transferred from a blast furnace is prepared in the converter (S10). Here, the lance 100 is lowered into the converter 1 to remove impurities in the molten iron and positioned at a desired height over the molten iron (S20).

After the lance 100 is thus positioned, blow refining of the molten iron is started by spraying an oxidative gas supplied from a gas supply apparatus to the molten iron (S30). Here, the oxidative gas moves in the lance 100, and the moving speed thereof is increased while passing the discharge hole 150. The oxidative gas discharged through the discharge part 190 may be sprayed to the molten iron at a high speed. As such, due to blowing of the oxidative gas, oxygen ($O_2$) in the oxidative gas and carbon (C) in the molten iron react with each other to generate CO gas (S40), and decarburization of the molten iron is performed. Hereinafter, the generated CO gas remains in the converter and simultaneously floats to an upper portion of the converter 1 due to gas characteristics.

Then, the CO gas floating upward is introduced into the lance 100 through the suction hole 170 formed on a side surface of the lance 100. Here, the CO gas is introduced into the suction hole 170 due to a Venturi effect generated by the high-speed oxidative gas blown to the molten iron.

As such, the CO gas introduced into the lance 100 is mixed in the lance 100 with the oxidative gas previously existing in the lance 100. Here, the temperature of the gas is raised through the reaction of the oxidative gas and the CO gas. Also, since the CO gas is additionally introduced into the lance 100, an increased amount of mixed gas is blown into the converter than that in the case where only the oxidative gas is supplied. As a result, the flow rate of the gas blown to the molten iron is increased, and a secondary combustion ratio is also increased according to an increase in the temperature of the blown gas.

Hereinafter, examples in which effects of the lance in accordance with exemplary embodiments will be described. However, it should be noted that these embodiments are merely provided to more clearly understand the present invention, not to limit the scope of the present invention.

Figure 6:
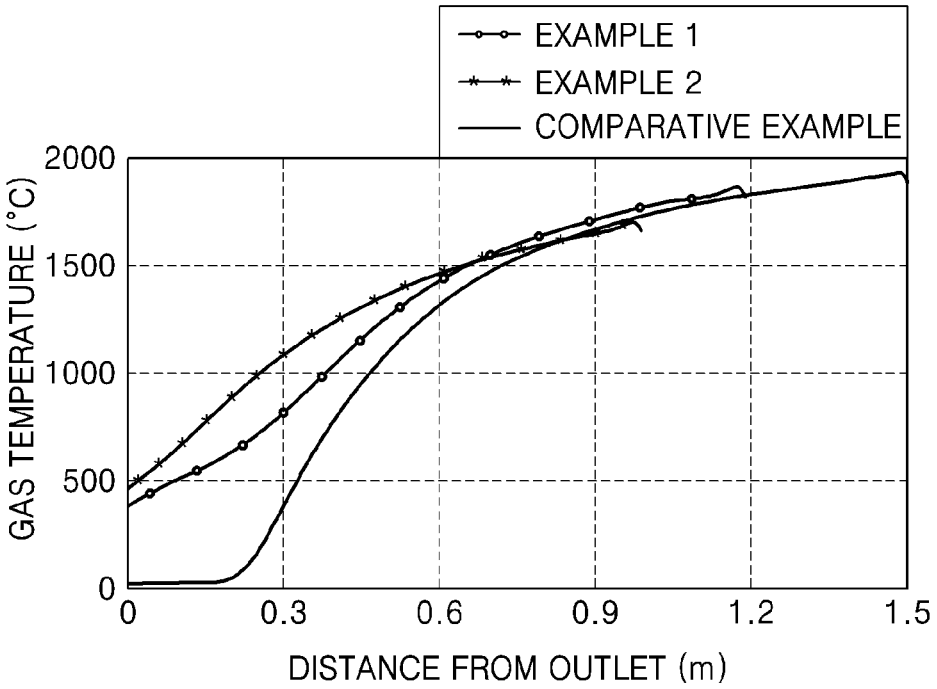
FIG. 6 is a graph showing a temperature change in discharged gas versus a distance from an end of a discharge part of the lances of Embodiments 1 and 2.

FIG. 6 is a graph showing a temperature change in discharged gas versus a distance from a discharge hole of a lance.

A heat flow analysis by using a fluid analysis program was performed in order to determine: whether CO gas, which is the reaction gas surrounding the lance, is really suctioned into the lance 100; how much the suctioned amount is; and what an average gas temperature is when the gas is discharged to the discharge part 190 after being reacted with the oxidative gas, in the case where the lance in accordance with the exemplary embodiments was used.

A calculation for analysis was performed under an assumption of Table 1 below.

TABLE 1

| Converter (mm) | | Molten Iron | Blow refinement | Transferred amount of oxidative gas | Reaction gas Generated amount | | Initial temperature | Heat transfer coefficient |
|---|---|---|---|---|---|---|---|---|
| | Inner | (ton) | time (min) | ($Nm^3$/min) | (%) | | (°C) | ($W/m^2 \cdot K$) |
| Height | diameter | 3 | 20 | 6 | CO | $CO_2$ | 1500 | 10000 |
| 2065 | 1226 | 3 | 20 | 6 | 95 | 5 | 1500 | 10000 |

That is, approximately 2 ton of molten iron is accommodated in a test converter having the height of approximately 2065 mm and the inner diameter of approximately 1226 mm, then, it is assumed that approximately 95% of CO and approximately 5% of $CO_2$ with respect to 100% of a reaction gas generated by an reaction of oxygen blown to the molten iron and carbon in the molten iron, under a blowing time of approximately 20 minutes and a transferred amount of oxidative gas of approximately 6 $Nm^3$/min. Here, the calculation is performed under conditions that the temperature of the initially generated reaction gas is assumed to be approximately 1500° C.; and the blow lance is cooled while heat transfer coefficient at an inner surface thereof, is assumed to be about 1000 $W/m^2 \cdot K$, and is cooled considering a water cooling for minimizing high-temperature effects.

Also, the above-mentioned oxygen blowing lance uses lances of types illustrated in FIGS. 4 and 5. The lances in accordance with the first and second embodiments respectively have suction holes 170 for suctioning surrounding gas at a lower sidewall of a single-hole supersonic nozzle, and are formed to have different shapes extending in a downward direction in order to investigate effects achieved in each embodiment. Here, detailed dimensions of the lances of the first and second embodiments are shown in Table 2 below.

TABLE 2

| Dimension (mm) | | | | | | | | |
|---|---|---|---|---|---|---|---|---|
| a | b | c | d | e | f | g | h | i |
| 12 | 17 | 21 | 10 | 41 | 191 | 160 | 200 | 69 |

Here, the calculation is performed under an assumption that the suction hole 170 formed at a sidewall has a cylindrical shape which is formed by rotating the cross-sectional shapes of FIGS. 4 and 5 about a longitudinal axis.

Referring to Table 2, it may be understood that the lance 100*b* in accordance with the second embodiment illustrated in FIG. 5 is formed to extend longer by a length h in comparison with the lance 100*a* in accordance with the first embodiment, and a gas passage in the lance 100*b* is formed to expand, shrink, and expand from the portion of the discharge hole 150. That is, it may be understood that an end of the discharge part 190*a* through which the gas is discharged in the lance 100*a* in accordance with the first embodiment has a diameter e, and an end of the discharge part 190*b* in the lance 100*b* in accordance with the second embodiment has a size i greater than e.

In Table 3, values representing calculation results related to the suctioning of CO gas in the lances of the first and second embodiments are shown.

TABLE 3

| | Reaction gas suction parameters | | |
|---|---|---|---|
| | Speed (m/s) | Flow rate (kg/s) | Ratio (wt %) |
| Embodiment 1 | 75.47 | 0.04 | 28.2 |
| Embodiment 2 | 117.95 | 0.064 | 45.1 |

Here, the speed represents a speed of the reaction gas introduced through the suction hole formed in each of the lances, and the flow rate is a flow rate of the reaction gas introduced through the suction hole. Also, the ratio is a value which is an amount of suctioned reaction gas represented in wt % with respect to a total amount of oxygen supplied into the converter.

The following results may be understood from Table 3 above.

Embodiment 1 vs. Embodiment 2

It may be understood from Table 3 that a speed of the reaction gas introduced through the suction hole is approximately 75.47 m/s, a flow rate is approximately 0.04 kg/s, and a suctioning ratio with respect to oxygen is approximately 28.2 wt %, in the lance 100*a* of Embodiment 1. Also, in the lance 100*b* of Embodiment 2, a speed of the reaction gas is approximately 117.95 m/s, an introduced flow rate is approximately 0.064 kg/s, and a suctioning ratio with respect to oxygen is approximately 45.1 wt %. Thus, it may be understood that all reaction gas suctioning parameters are larger than those of the lance 100*a* of the first embodiment.

Here, the parameters of Embodiment 2 have higher values than those of Embodiment 1 because efficiency of each of the parameters is increased due to an internal shape of the wall body extending to a lower portion of the lance 100*b*. That is, why the parameters of Embodiment 2 have higher values than those of Embodiment 1 is because the lance 100*b* of Embodiment 2 is formed in a shape such that a cross-sectional shape of the gas passage affects the speed of the gas in the lance 100*b*. More specifically, the lance of Embodiment 2 is formed to have a shape similar to a Venturi tube, which has upper and lower portions becoming wider like trumpets with respect to a central portion. Accordingly, the speed of the gas is increased and an internal pressure is decreased when the gas passes through the central portion of the lance 100*b* according to the Bernoulli's law.

Hence, internal pressure of the lance 100*b* of Embodiment 2 is relatively lower than that of the lance 100*a* of Embodiment 1. This is a phenomenon in which a reaction gas in the converter, which has a pressure relatively higher than the internal pressure of the lances of Embodiment 1 and Embodiment 2, is suctioned into the lance 100. Since the internal pressure of the lance 100*b* of Embodiment 2 is lower than that of Embodiment 1, the movement of the reaction gas for stabilizing an external pressure and the inner pressure of the lance is more actively performed in the lance 100*b* of Embodiment 2 than in Embodiment 1, and thus the speed, flow rate, and ratio of the reaction gas moving into the lance have higher values than those in Embodiment 1 (lance 100*a*).

It may be understood from the description above that the reaction gas (CO gas) is introduced into the lance 100 by forming a suction hole 170 in the lance 100, and the values of the parameters of the introduced reaction gas vary with lance shapes. Accordingly, referring to a graph in FIG. 6, it may be confirmed that the temperatures of the discharged gas in Embodiment 1 and Embodiment 2 are higher than that in comparative example when considering the distance from a discharge hole of the lance. That is, since the temperature of the gas mixed by the reaction of the oxidative gas and the reaction gas (CO gas) is increased, the gas may be discharged from the lance at a higher temperature than typical lances from the beginning. Accordingly, since the discharging temperature of the gas is maintained high from the beginning, an environment under which oxygen contained in the gas introduced into the converter may be easily react with surrounding CO gas. Thus the secondary combustion ratio is improved.

Here, although lances with various shapes capable of increasing the gas introduced into the lance 100 are exemplarily described, the shapes of the lance 100 are not limited to those of the lance of Embodiments 1 and 2, but may be formed to increase the secondary combustion ratio by being modified into various shapes which have suction holes 170 and increase the suctioning speed, suctioning amount, suctioning ratio of the reaction gas.

After the effects of the lance 100 of the embodiments are verified through Table 3 shown above, determination of specific dimensions is required to practically manufacture the lance 100. Accordingly, an experiment is performed according to the size of the suction hole 170 formed in the lance 100. Here, the experiment is performed by using the lance 100*b* of Embodiment 2 which shows higher parameter values between the above-described lances of Embodiment 1 and Embodiment 2.

Figure 7:
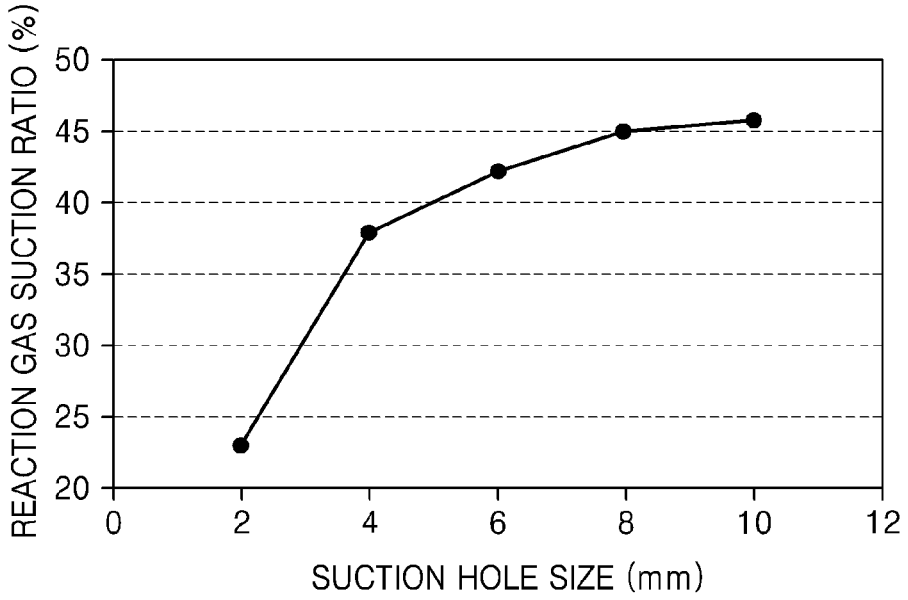
FIG. 7 is a graph showing a change in a suction ratio of a reaction gas versus a size of the suction hole of the lance of FIG. 5.
Figure 8:
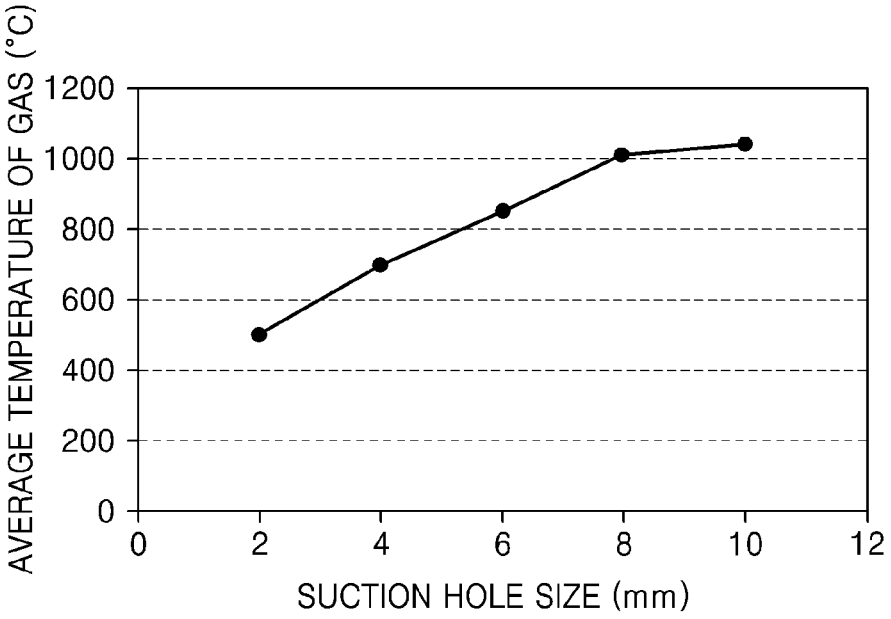
FIG. 8 is a graph showing a change in an average temperature of gas at an end of a gas discharge part versus a size of a suction hole of the lance of FIG. 5.
Figure 9:
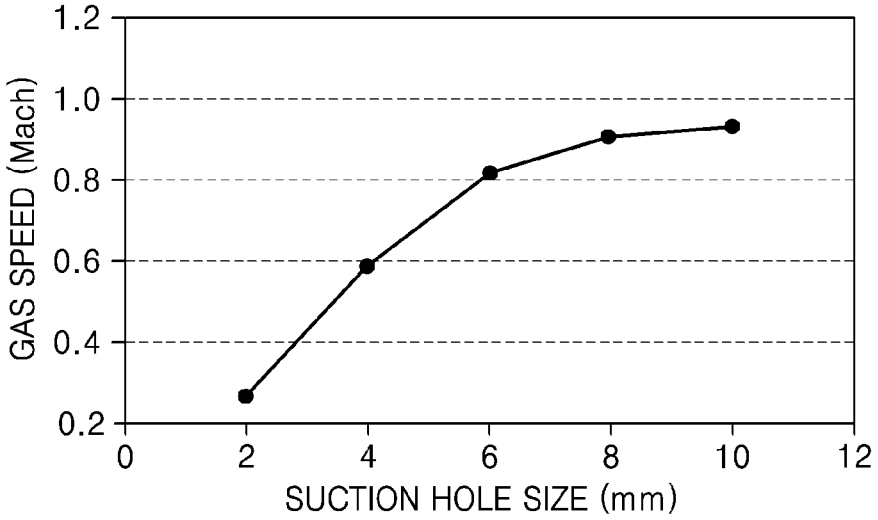
FIG. 9 is a graph showing a change in a gas speed at an end of a gas discharge part versus a size of a suction hole of the lance FIG. 5.

FIG. 7 is a graph showing a change in suction ratio of a reaction gas versus the size of the suction hole of the lance of FIG. 5. FIG. 8 is a graph showing a change in average temperature of gas at an end of a gas discharge part versus the size of a suction hole of the lance of FIG. 5. FIG. 9 is a graph showing a change in gas speed at an end of a gas discharge part versus the size of a suction hole of the lance of FIG. 5.

Referring to FIGS. 7 to 9, it may be understood that as the size of the suction hole 170 of the lance 100*b* is increased, a ratio of the reaction gas introduced through the suction hole 170, an average temperature of the gas discharged through the discharge part 190*b*, and a speed of the discharged gas are increased. However, it may be understood that each of the parameters is slowly increased in comparison with the increase in the size of the suction hole 170. As the size of the suction hole 170 is increased, the difference between internal and external pressures of the lance 100*b* becomes smaller, and effects obtained by forming the suction hole 170 may be rather decreased. Also, when the suction hole 170 is formed too large, it is difficult to design a cooling line. Hence, it is preferable to form the suction hole 170 in a suitable size. Accordingly, the most preferable size of the suction hole 170 may be approximately 10 mm for the lance 100*b* of Embodiment 2. However, the size of the suction hole is not limited thereto, and may vary with a lance being used.

As described above, the lance in accordance with embodiments suctions the CO gas generated by the oxygen blowing into the molten iron in the converter accommodating the molten iron, and mixes the oxidative gas and the CO gas in the lance. Thus, the temperature and flow rate of the gas discharged through the lance may be increased.

When the gas is thus blown into the converter, the second combustion ratio is increased. Also, the high-temperature gas functions to supply additional heat into the converter, the problems of the related arts may be solved through increasing the use of scraps and low price iron sources, saving in heating agents, suppressing excessive blow by a thermal margin. Thus, production costs may be reduced and productivity may be improved.

Although the specific embodiments have been described in the detailed description of the present invention, it should be understood that various modifications can be made without departing from the scope of the present invention. Therefore, the scope of the present invention should not be limited to the described embodiments, but should be determined by the accompanying claims and equivalents thereof.

What is claimed is:

1. A lance for blowing a source gas into a container in which a reaction gas is generated, the lance comprising:

a wall body forming a vertical gas passage inside thereof, a source gas being capable of flowing downwards through the vertical gas passage;

a gas storage part formed in an upper portion of the vertical gas passage of the wall body, wherein the gas storage part accommodates the source gas;

a mixing part formed under the gas storage part, the mixing part having a predetermined vertical length, wherein the source gas accommodated in the gas storage part is discharged into the mixing part;

a suction hole formed to penetrate the wall body toward the mixing part at a position between the gas storage part and the mixing part, the suction hole being inclined towards the mixing part in such a way that a first reaction gas is suctioned into the mixing part from outside the vertical gas passage and reacted with the source gas discharged from the gas storage part to form a second reaction gas; and a discharge part formed under the gas mixing part, the discharge part having a predetermined vertical length, wherein the second reaction gas is discharged through the discharge part, wherein the mixing part is gradually narrowed toward the discharge part.

2. The lance of claim 1, wherein the storage part is gradually narrowed toward the mixing part.

3. The lance of claim 1, wherein the storage part includes a discharge hole at an end of the storage part, wherein the source gas temporarily accommodated in the gas storage part is discharged through the discharge hole into the mixing part.

4. The lance of claim 3, wherein the discharge hole is gradually broadened toward the mixing part.

5. The lance of claim 1, wherein the discharge part is gradually broadened in a downward direction.

* * * * *